US008733375B2

(12) United States Patent
Classen et al.

(10) Patent No.: US 8,733,375 B2
(45) Date of Patent: May 27, 2014

(54) WATER CONDUCTING HOUSEHOLD APPLIANCE

(75) Inventors: Egbert Classen, Stahnsdorf (DE); Helmut Jerg, Giengen (DE); Hans-Peter Nannt, Gerstetten (DE); Kai Paintner, Adelsried (DE); Thomas Wachinger, Hohenzell (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1029 days.

(21) Appl. No.: 12/745,695

(22) PCT Filed: Nov. 11, 2008

(86) PCT No.: PCT/EP2008/065292

§ 371 (c)(1),
(2), (4) Date: Jun. 2, 2010

(87) PCT Pub. No.: WO2009/077266

PCT Pub. Date: Jun. 25, 2009

(65) Prior Publication Data

US 2010/0252081 A1 Oct. 7, 2010

(30) Foreign Application Priority Data

Dec. 14, 2007 (DE) ..... 10 2007 060 193

(51) Int. Cl.
*B08B 3/00* (2006.01)

(52) U.S. Cl.
USPC ..... 134/110; 134/104.4; 134/111; 134/104.1; 134/10; 210/167.01; 210/258; 210/409; 210/650; 68/18 F

(58) Field of Classification Search
USPC ..... 134/10, 111, 110, 56 D, 18, 104.4, 105, 134/104.2, 184, 21, 57 R, 58 D, 94.1, 95.1; 417/410.1, 53, 423.3, 307, 44.1, 423.1, 417/423.14; 210/167.01, 173, 258, 259, 210/409, 650, 787, 806; 68/18 F
See application file for complete search history.

(56) References Cited

U.S. PATENT DOCUMENTS

| | | | | |
|---|---|---|---|---|
| 3,949,578 | A * | 4/1976 | Heldreth | 68/18 F |
| 3,949,579 | A | 4/1976 | Bertoldi | |
| 5,601,600 | A | 2/1997 | Ton | |
| 5,601,660 | A * | 2/1997 | Jeon et al. | 134/10 |
| 6,418,943 | B1 * | 7/2002 | Miller | 134/104.1 |
| 2006/0219272 | A1 | 10/2006 | Lee et al. | |
| 2008/0116135 | A1 | 5/2008 | Rieger et al. | |

FOREIGN PATENT DOCUMENTS

| | | |
|---|---|---|
| DE | 8318398 U1 | 10/1983 |
| DE | 19636014 A1 | 5/1997 |

* cited by examiner

*Primary Examiner* — Michael Barr
*Assistant Examiner* — Thomas Bucci
(74) *Attorney, Agent, or Firm* — James E. Howard; Andre Pallapies

(57) ABSTRACT

A water conducting household appliance, particularly a dishwasher or a washing machine, having a hydraulic circuit, in which cleaning fluid can be recycled and in which at least one further filter is provided for filtering recycled washing liquor. In an exemplary embodiment, the appliance includes a filter in the hydraulic circuit for filtering recycled washing liquor. The filter may be disposed in a region of the hydraulic circuit in which the recycled washing liquor is rotated.

14 Claims, 2 Drawing Sheets

WATER CONDUCTING HOUSEHOLD APPLIANCE

BACKGROUND OF THE INVENTION

In order to prevent the line system in which washing liquor is circulated in water conducting household appliances, such as dishwashers for example, becoming contaminated with dirt particles, a filter system is used, which may comprise a coarse filter, a fine filter and a micro filter. The coarse filter here serves to retain dirt particles, which could lead to a blockage of the washing liquor pump. A fine filter retains particles with a particle size greater than approximately 1 mm and a micro filter retains particles with a particle size greater then approximately 0.15 mm.

A water conducting household appliance such as a dishwasher for example has a washing liquor pump, which can be used to convey washing liquor that is contaminated at the end of the washing operation out of the dishwasher into a house-side waste water disposal system. Such washing liquor pumps are designed so that they can convey larger particle sizes unimpeded and there is no blockage of the washing liquor pump. Washing liquor pumps are therefore disposed so that contaminated washing liquor is only filtered coarsely during the pumping operation.

A dishwasher also has a circulation pump, which can be used to circulate washing liquor during a cleaning operation; in other words fluid collecting in the pump sum of a dishwasher is fed by means of the circulation pump through a hydraulic system to spray arms disposed in the interior of the washing compartment, said spray arms then spraying washing liquor onto the items to be washed in a regular manner. The spray arms have relatively small openings so it is necessary to pass the circulated washing liquor through the fine and micro filters so that even the smallest particles are retained and the outlet openings of the spray arms cannot become blocked. The circulation pump is configured accordingly in respect of particle size tolerance.

BRIEF SUMMARY OF THE INVENTION

The object of the invention is to provide a water conducting household appliance, in particular a dishwasher or washing machine, the filters of which have a greater reliability.

The invention is based on a water conducting household appliance, in particular a dishwasher or washing machine, having a hydraulic circuit in which washing fluid can be circulated and in which at least one additional filter is provided to filter circulated washing liquor. The inventive solution is characterized in that at least one additional filter is provided in the hydraulic circuit to filter circulated washing liquor, being disposed in a region of the hydraulic circuit, in which circulated washing liquor is rotated. The rotation of the circulated washing liquor and/or its turbulent flow means that the filter surface of the additional filter is not affected by filter cake formation but an unimpeded passage of washing fluid or washing liquor is ensured. It can be a complete rotation or a sectionally circular or arced rotation or deflection movement, which is produced for example by deflection means such as baffles or a channel guide.

To this end means generating a rotation of circulated washing liquor are preferably provided in the region of the hydraulic circuit. These can be fixed baffles or vanes which impose a rotation on the flowing washing fluid. However provision is preferably made for the means generating a rotation of circulated washing liquor to comprise a circulation pump to circulate washing fluid.

Provision is preferably made for the additional filter to be disposed in the circulation pump. It is therefore optionally possible to extend the filter combination generally provided in the dishwasher to include the additional filter. Alternatively it is possible to dispense with a filter disposed in the pump sump, with the result that the pump sump can have smaller dimensions and the quantity of dead water in the pump sump to be heated can advantageously be reduced.

The filter combination disposed in the pump sump is advantageously connected upstream of the additional filter in the flow direction of the washing fluid, said filter combination being able to carry out at least coarse and/or fine filtration. The washing fluid supplied to the additional filter is therefore already precleared so the additional filter can be embodied as a micro filter, which is designed specifically to filter out dirt particles that are finely dispersed in the water.

The pump housing of the circulation pump can have an impeller chamber with an impeller that conveys the washing fluid and a pressure chamber disposed downstream therefrom, into which the washing liquid conveyed by the impeller flows at a high flow speed. The pressure chamber can merge in the flow direction into a flow channel, which guides the washing fluid to an outlet-side pressure connection of the circulation pump. The additional filter is preferably disposed in the pressure chamber, with the result that its filter surface is constantly washed clear due to the major turbulence of the washing fluid flowing into the pressure chamber and cannot therefore be affected by filter residues.

The pressure chamber preferably extends in an annular manner about a center axis of the circulation pump. With a corresponding flow alignment it is possible for the washing fluid to flow through the pressure chamber in a rotational movement, in other words tangentially in relation to a pump housing wall bounding the pressure chamber. The flow direction can be constructed correspondingly by a flow routing element, for example a guide vane, connected between the impeller chamber and the pressure chamber, in the peripheral direction. Such a circular crossflow in the pressure chamber ensures that the washing fluid remains in the pressure chamber for longer and flows completely over the entire filter surface of the additional filter.

For a good filter performance it must be ensured that all the circulated washing liquid flows through the additional filter. To this end the additional filter can divide the pressure chamber, through which the flow passes, into an inlet chamber, into which the washing fluid flows, and an outlet chamber, from which the washing fluid flows to an outlet-side pressure connection of the circulation pump. It is favorable from a flow engineering point of view if the inlet chamber of the pressure chamber is located radially outside the outlet chamber of the pressure chamber in relation to the center axis of the circulation pump. The washing liquid can thus flow over the additional filter in a rotational movement along a radial outer wall of the pump housing.

To further enhance filter performance it is advantageous if the additional filter has at least one, preferably disk-shaped filter means, which is positioned on a hollow cylindrical filter means support, which divides the pressure chamber into the abovementioned inlet and outlet chambers. For the biggest possible filter surface the filter means provided on the filter means support can project into the inlet chamber. The outer edge of the filter means here is however preferably not in contact with a pump housing wall radially opposite it but is kept at a distance from this by way of a flow gap, to ensure the biggest possible flow around the filter means.

A number of filter means that are kept at a distance from one another by way of filter chambers are preferably positioned on the hollow cylindrical filter means support. The disk-shaped filter means therefore extend together with these filter chambers in an annular manner about the center axis of the circulation pump within the pressure chamber. Therefore with a fluid flow guided to move in a rotating manner through the pressure chamber there is a flow over a large area of the filter surfaces within said filter chambers, with the result that the filter surfaces are constantly washed clear and filter residues cannot affect the filter surfaces. The cleaning of the additional filter, in other words the cleaning of the inlet chamber upstream of the additional filter, can be effected by means of a flow reversal or a backwashing of washing liquid, with the result that the filter residues are carried back into the pump sump. Alternatively the filter residues collecting on a side wall of the pressure chamber can be routed away by way of a separate, valve-controlled channel into the pump sump, from where they can be routed into the waste water system by means of a washing liquor pump. To assist with the removal of residues affecting the filter surfaces of the filter means, at least one freely movable cleaning unit can be provided in the abovementioned filter chambers, which can be moved freely in the filter chambers by means of the circular crossflow of the washing fluid.

In one preferred embodiment a heating element to heat the washing fluid is assigned to the pressure chamber of the circulation pump. Therefore not only is the additional filter disposed in the pressure chamber but additionally in a double function the washing fluid is also heated. The high level of turbulence of the washing fluid flowing into the pressure chamber at a high flow speed means that the washing fluid circulated in the hydraulic circuit is heated in an accelerated manner in the pressure chamber.

BRIEF DESCRIPTION OF THE DRAWINGS

An exemplary embodiment of the invention is described below with reference to the accompanying figures, in which.

DETAILED DESCRIPTION OF EXEMPLARY EMBODIMENTS OF THE PRESENT INVENTION

Figure 1:
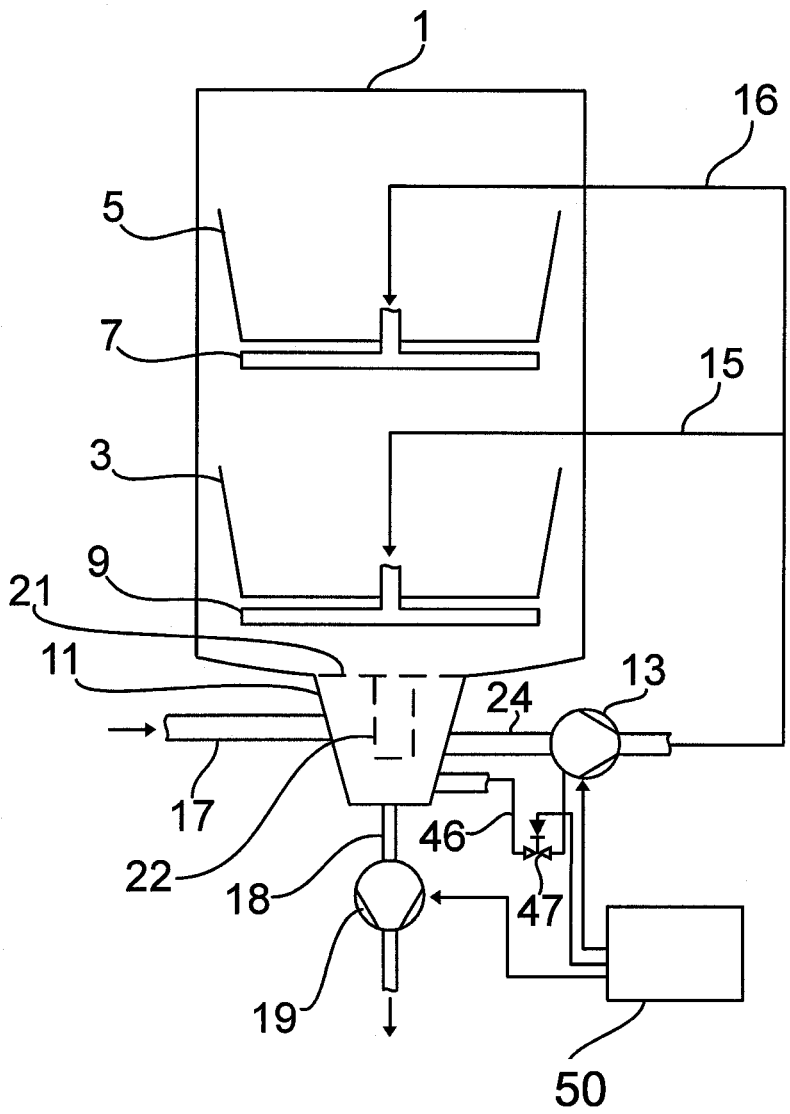
FIG. 1 shows a schematic block diagram of an inventive dishwasher.

FIG. 1 shows a rough schematic diagram of a dishwasher having a washing compartment 1, in which items to be washed (not shown) can be disposed in baskets 3, 5. Two spray arms 7, 9 provided at different spray levels are disposed as spray facilities by way of example in the washing compartment 1 shown and are used to spray washing fluid onto the items to be cleaned. Below the washing compartment base is a pump sump 11 with an assigned circulation pump 13, which is connected for flow engineering purposes to the spray arms 7, 9 by way of fluid lines 15, 16. The pump sump 11 is also connected by way of connectors to a fresh water supply line 12 coupled to the water supply network and a outlet line 18, in which a washing liquor pump 19 is disposed to pump contaminated washing fluid out of the washing compartment.

Figure 2:
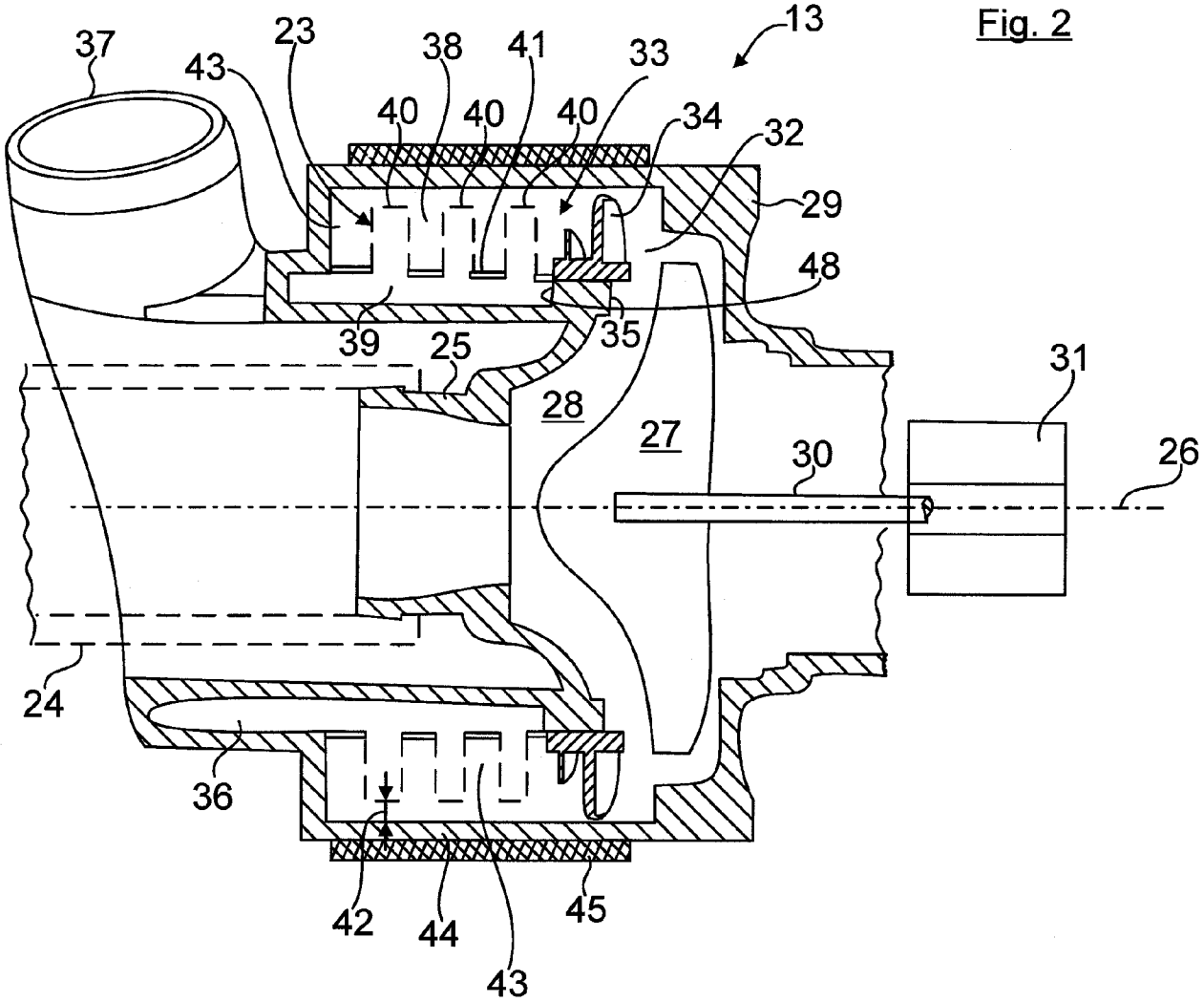
FIG. 2 shows a side view of a hydraulic circuit of the circulation pump used in the dishwasher.

As shown in FIG. 1, the top face of the pump sump 11 is provided with a large, funnel-shaped fine filter 21, with a hollow cylindrical cup-shaped coarse filter 22 inserted into its center. The fine filter 21 and the coarse filter 22 together with an additional filter 23 inserted into the circulation pump 13 as shown in FIG. 2 form a three-part filter system. In the filter system coarse and fine filtration take place by means of the fine and coarse filters 21 and 22, while micro filtration takes place by means of the additional filter 23 described below.

The pump sump 11 is connected by way of a fluid line 24 to the downstream circulation pump 13. As shown in FIG. 2, the line end of the fluid line 24 is pushed onto an intake connection 25 of the circulation pump 13, which is coaxial to the center axis 26 of the circulation pump 13 here by way of example. The circulation pump 13 has an impeller 27 that can be rotated about the enter axis 26 and is provided in an impeller chamber 28 within a pump housing 29. The impeller 27 is connected for drive purposes to an electric motor 31 (only shown in outline) by way of a drive shaft 30.

The impeller chamber 28 is connected at its radially outer side to an annular pressure chamber 33 for flow purposes by way of an annular gap 32. The pressure chamber 33 extends with rotational symmetry about the center axis 26 and radially outside by way of the connector 25. A guide vane 34 is provided as a flow routing element in the annular gap 32 between the impeller chamber 28 and the pressure chamber 33, being positioned on a bearing seat 35 of the pump housing 26 in a non-rotating manner. The helical routing walls of the guide vane 34 are angled so steeply that the inflowing washing fluid flow flows through the pressure chamber 33 in a radial peripheral direction at a high flow speed, in other words tangentially in relation to the cylindrical pump housing wall 44. The washing fluid flow flowing into the pressure chamber 33 therefore has a small speed component in the axial direction. Adjoining downstream from the pressure chamber 33 is an annular flow channel 36, through which the washing fluid is conveyed tangentially through an outlet-side pressure connection 37 into the fluid line 14.

As mentioned above, the additional filter 23 is disposed in the pressure chamber 33. The additional filter 23 divides the pressure chamber 33 into a radially outside inlet chamber 38 and a radially inside outlet chamber 39. The additional filter 23 here has three disk-shaped filter means 40 by way of example, these being positioned on a hollow cylindrical filter means support 41, which extends in an axial direction through the pressure chamber 33. The filter means support 41 may be a pipe segment, the end faces of which are in contact with opposing boundary walls 48 of the pressure chamber 33. The outer edges of the disk-shaped filter means 40 are kept at a distance from a housing outer wall 44 by way of a free flow gap 42.

The disk-shaped filter means 40 project in a radial direction outward into the inlet chamber 38. In the axial direction the filter means are kept at a distance by way of annular filter chambers 43, in which cleaning units are optionally provided to remove filter residues from the filter surface.

As also shown in FIG. 2, a thick film heating element 45 shown here by way of example is provided on the outside of the housing outer wall 44, heating the washing fluid circulated by the circulation pump 13.

During a circulation operation the washing fluid is taken in by the rotating impeller 27 and guided at a high flow speed through the impeller chamber 28 into the pressure chamber 33. The filter means 40 disposed in the pressure chamber 33 are flowed over in a circular crossflow by corresponding flow alignment at the guide vane 34. The crossflow removes residues from the filter surface of the disk-shaped filter means 40 and the centrifugal effect forces them outward onto the housing outer wall 44. The filter residues collect in the lower region of the housing outer wall 44 in this process.

The filter residues in the inlet chamber 38 of the pressure chamber 33 can be guided back into the pump sump 11 by the circulation pump 13 by means of backwashing. To this end the impeller 27 can be actuated in a direction of rotation counter to the conveyance direction.

As an alternative to backwashing a valve-controlled outlet line 46 opening into the base region of the housing side wall 44 can be provided, as shown in FIG. 1. The outlet line 46 can remove filter residues from the circulation pump. To this end the outlet line 46 has as a blocking element a solenoid valve 47, which can be opened and closed by the control facility 50. The outlet line 46 is connected to the pump sump 11. The control facility 50 can open the solenoid valve 47 at the same time as the washing liquor pump 19 is actuated in a cleaning operation. This allows the filter residues that have collected in the pressure chamber 33 to be routed into the waste water system by way of the outlet line 46 and the pump sump.

LIST OF REFERENCE CHARACTERS

1 Washing compartment 43 Filter chambers
3, 5 Baskets 44 Heating element
7, 9 Spray arms 45 Housing outer wall
11 Pump sump 46 Discharge line
13 Circulation pump 47 Blocking element
15 Fluid line 48 Boundary wall
16 Fluid line
17 Fresh water supply line
18 Outlet line
19 Washing liquor pump
21 Fine filter
22 Coarse filter
23 Additional filter
24 Fluid line
25 Intake connection
26 Center axis
27 Impeller
28 Impeller chamber
29 Pump housing
32 Annular gap
33 Pressure chamber
34 Guide vane
35 Bearing seat
36 Flow channel
37 Pressure connection
38 Inlet chamber
39 Outlet chamber
40 Filter means
41 Filter means support
42 Flow gap
43 Filter chambers
44 Heating element
45 Housing outer wall
46 Discharge line
47 Blocking element
48 Boundary wall

The invention claimed is:

1. A water conducting household appliance, comprising:

a hydraulic circuit, in which washing fluid is circulated and at least one filter included in the hydraulic circuit and structured to filter circulated washing liquor; and a circulation pump structured to generate the rotation of circulated washing liquor, wherein the circulation pump includes an impeller chamber with an impeller that conveys the washing liquor and a pressure chamber disposed downstream therefrom, and wherein the at least one filter is disposed in the pressure chamber and divides the pressure chamber into an inlet chamber, into which the washing liquor flows, and an outlet chamber, from which the washing liquor flows to an outlet-side pressure connection of the circulation pump, and wherein the inlet chamber of the pressure chamber is disposed radially outside the outlet chamber of the pressure chamber in relation to a center axis of the circulation pump.

2. The water conducting household appliance as claimed in claim 1, wherein at least one of the inlet chamber and the outlet chamber extend in an annular manner about a center axis of the circulation pump.

3. The water conducting household appliance as claimed in claim 2, further comprising a flow routing element connected between the impeller chamber and the pressure chamber.

4. The water conducting household appliance as claimed in claim 3, wherein the flow routing element is structured to introduce the washing liquor tangentially along a housing wall of the circulation pump.

5. The water conducting household appliance as claimed in claim 4, further comprising a pump sump connected upstream of the circulation pump, the pump sump including at least one of a coarse filter and fine filter disposed therein.

6. The water conducting household appliance as claimed in claim 5, wherein the at least one of a coarse filter and a fine filter have a bigger mesh width than the at least one filter.

7. The water conducting household appliance as claimed in claim 6, wherein the at least one filter includes at least one disk-shaped filter, which is positioned on a hollow cylindrical filter support, which divides the pressure chamber into the inlet and outlet chambers.

8. The water conducting household appliance as claimed in claim 7, wherein the hollow cylindrical filter support extends coaxially to the circulation pump center axis between opposing boundary walls of the pressure chamber.

9. The water conducting household appliance as claimed in claim 8, wherein the disk-shaped filter projects into the inlet chamber and at least one of the inlet and outlet chambers is bounded between at least one of the disk-shaped filter and the pump housing wall, extending in an annular manner about the center axis of the circulation pump.

10. The water conducting household appliance as claimed in claim 9, wherein the disk-shaped filter is disposed at a radial distance from the pump housing wall in a radial direction outward by way of a flow gap.

11. The water conducting household appliance as claimed in claim 10, further comprising at least one freely movable cleaning unit disposed in the pressure chamber.

12. The water conducting household appliance as claimed in claim 11, further comprising a heating element structured to heat the washing liquor, wherein the heating element is disposed in the pressure chamber of the circulation pump.

13. The water conducting household appliance as claimed claim 12, wherein the circulation pump is connected to the pump sump by a discharge line.

14. The water conducting household appliance as claimed in claim 13, further comprising a blocking element disposed in the discharge line, which opens the discharge line when a washing liquor pump discharges the washing liquor from the pump sump.

* * * * *